US008584654B2

(12) United States Patent
Closet et al.

(10) Patent No.: US 8,584,654 B2
(45) Date of Patent: Nov. 19, 2013

(54) METHOD AND DEVICE FOR CONTROLLING A TANK VENTILATION DEVICE FOR A MOTOR VEHICLE

(75) Inventors: Stephane Closet, Lindau (DE); Wolfgang Mai, Kronberg (DE); Jens Pache, Helsa (DE)

(73) Assignee: Continental Automotive GmbH, Hannover (DE)

( * ) Notice: Subject to any disclaimer, the term of this patent is extended or adjusted under 35 U.S.C. 154(b) by 471 days.

(21) Appl. No.: 13/000,113

(22) PCT Filed: May 27, 2009

(86) PCT No.: PCT/EP2009/056437

§ 371 (c)(1),
(2), (4) Date: Feb. 14, 2011

(87) PCT Pub. No.: WO2009/156239

PCT Pub. Date: Dec. 30, 2009

(65) Prior Publication Data

US 2011/0139261 A1 Jun. 16, 2011

(30) Foreign Application Priority Data

Jun. 25, 2008 (DE) ..... 10 2008 030 089

(51) Int. Cl.
*F02M 33/02* (2006.01)

(52) U.S. Cl.
USPC ..... 123/520; 73/114.39

(58) Field of Classification Search
USPC ..... 123/516, 518–520, 198 D; 73/114.39
See application file for complete search history.

(56) References Cited

U.S. PATENT DOCUMENTS

| | | | | |
|---|---|---|---|---|
| 5,216,991 | A | 6/1993 | Iida et al. | 123/339 |
| 5,327,776 | A * | 7/1994 | Yasui et al. | 73/49.2 |
| 5,400,759 | A * | 3/1995 | Ishida | 123/520 |
| 5,437,256 | A | 8/1995 | Woletz et al. | 123/519 |
| 5,445,132 | A * | 8/1995 | Isobe et al. | 123/520 |
| 5,460,137 | A | 10/1995 | Zabeck et al. | 123/520 |
| 5,731,514 | A * | 3/1998 | Miwa et al. | 73/114.39 |

(Continued)

FOREIGN PATENT DOCUMENTS

| | | | |
|---|---|---|---|
| DE | 4229110 | C1 | 10/1993 |
| DE | 4307100 | A1 | 9/1994 |
| DE | 102004022999 | B3 | 12/2005 |
| DE | 102005049068 | A1 | 4/2007 |

OTHER PUBLICATIONS

International PCT Search Report and Written Opinion, PCT/EP2009/056437, 11 pages, Sep. 14, 2009.

*Primary Examiner* — Thomas Moulis
(74) *Attorney, Agent, or Firm* — King & Spalding L.L.P.

(57) ABSTRACT

A method for controlling a tank ventilation device (102) for a motor vehicle (100) is proposed in which first of all a tank vent valve (28) of the tank ventilation device (102) is closed. Then, the value of a control signal for the tank vent valve (28) is increased in the sense of an opening of the tank vent valve (28) until a leak detection means (23, 31) associated with the tank ventilation device (102) recognizes a leak in the tank ventilation device (102). The value of the control signal at which the leak in the tank ventilation device (102) is recognized is identified as the opening control value for opening the tank vent valve (28). In this way, the opening control value for the tank vent valve (28) can be determined with a high frequency and precision.

19 Claims, 3 Drawing Sheets

(56) References Cited

U.S. PATENT DOCUMENTS

| | | | | | |
|---|---|---|---|---|---|
| 5,765,540 | A * | 6/1998 | Ishii et al. | 123/520 |
| 5,850,820 | A * | 12/1998 | Tsutsumi et al. | 123/520 |
| 5,873,350 | A * | 2/1999 | Wild et al. | 123/520 |
| 6,089,080 | A * | 7/2000 | Takaku et al. | 73/114.39 |
| 6,131,551 | A | 10/2000 | Jamrog | 123/520 |
| 6,223,732 | B1 * | 5/2001 | Isobe et al. | 123/520 |
| 6,382,017 | B1 * | 5/2002 | Majkowski et al. | 73/49.7 |
| 6,804,995 | B2 * | 10/2004 | Kawano | 73/114.39 |
| 7,096,113 | B2 * | 8/2006 | Ludwig et al. | 701/114 |
| 7,441,550 | B2 * | 10/2008 | Ludwig et al. | 123/520 |
| 7,448,257 | B2 * | 11/2008 | Kimura | 73/49.7 |
| 8,104,333 | B2 * | 1/2012 | Takakura | 73/114.39 |
| 2003/0015179 | A1 * | 1/2003 | Kawano | 123/520 |
| 2006/0272400 | A1 | 12/2006 | Wakahara | 73/118.1 |

* cited by examiner

METHOD AND DEVICE FOR CONTROLLING A TANK VENTILATION DEVICE FOR A MOTOR VEHICLE

CROSS-REFERENCE TO RELATED APPLICATIONS

This application is a U.S. National Stage Application of International Application No. PCT/EP2009/056437 filed May 27, 2009, which designates the United States of America, and claims priority to German Application No. 10 2008 030 089.6 filed Jun. 25, 2008, the contents of which are hereby incorporated by reference in their entirety.

TECHNICAL FIELD

The invention relates to a method and a device for controlling a tank ventilation device for a motor vehicle.

BACKGROUND

To comply with legally required emission limits, modern motor vehicles are fitted with a tank ventilation device. The fuel vapors produced in the fuel tank are fed to an activated carbon filter where they are adsorbed. However, as the storage capacity of the activated carbon canister is limited, it must be regenerated from time to time. To this end, the activated carbon canister is connected to the intake manifold of the internal combustion engine via a venting line and a tank vent valve disposed therein. To regenerate the activated carbon canister, the tank vent valve is opened causing the fuel vapors absorbed in the activated carbon canister to be sucked into the intake tract of the internal combustion engine because of the negative pressure in the intake manifold and to participate in combustion as part of the fuel/air mixture. As a result of this tank venting process or rather regeneration process, an initially unknown amount of hydrocarbons is supplied to the engine so that the composition of the combustible mixture changes. As each change in the composition of the combustible mixture directly affects the combustion process and the exhaust gas composition of the engine, precise control of the tank vent valve is necessary.

The tank vent valve is mostly an electromagnetic valve whose degree of opening is set by means of a pulse-width-modulated control signal (PWM signal). For precise execution of the tank venting process it is necessary to know the opening instant of the tank vent valve, i.e. the control signal value at which the passage of gas through the tank vent valve occurs. This opening control value may vary because of manufacturing tolerances, fouling, deposits and other changes over service life.

According to a known strategy for estimating the opening control value, the tank vent valve is partially opened and the output signal of a lambda controller device of the internal combustion engine is monitored. As soon as the tank vent valve opens, the exhaust gas composition changes because of the additionally supplied hydrocarbons, which is detected by the lambda controller device. Consequently, as soon as a change in the output signal of the lambda controller device occurs, the opening control value of the tank vent valve can be determined. However, this method is subject to considerable limitations. In order to obtain a sufficient deviation of the lambda controller signal, the activated carbon canister must have a high degree of loading. Moreover, the method can only be carried out when the intake manifold pressure is low enough to suck in the fuel vapors. Particularly in the case of supercharged engines or engines with load control via the valve stroke, these conditions are only rarely encountered. In addition, this method is imprecise.

SUMMARY

According to various embodiments, a method and a device for controlling a tank ventilation device for a motor vehicle can be created, by means of which the opening control value for opening of the tank vent valve can be determined.

According to an embodiment, in a method for controlling a tank ventilation device for a motor vehicle, a tank vent valve of the tank ventilation device is closed, the value of a control signal for the tank vent valve is increased in terms of opening the tank vent valve until a leak detection means associated with the tank ventilation device detects a leak in the tank ventilation device, the value of the control signal at which the leak in the tank ventilation device is detected is identified as the opening control value for opening the tank vent valve.

According to a further embodiment, determination of the opening control value of the tank vent valve may only take place if the tank ventilation device was previously detected as leak-free. According to a further embodiment, the leak detection means may detect a leak in the tank ventilation device if the pressure in the tank ventilation device changes within an observation period. According to a further embodiment, the leak detection means may detect a leak in the tank ventilation device if the pressure in the tank ventilation device changes by more than a predefined limit amount, and/or if the gradient of the pressure change is greater than a predefined limit gradient. According to a further embodiment, the tank ventilation device can be associated with an internal combustion engine and, with the internal combustion engine turned off, the opening control value is only determined if the pressure in the tank ventilation device is lower than the pressure in an intake manifold of the internal combustion engine. According to a further embodiment, the tank ventilation device can be associated with an internal combustion engine and, after closing of the tank vent valve, the pressure in the tank ventilation device is reduced by a vacuum generating means to a predefined value which is lower than the current pressure in an intake manifold of the internal combustion engine. According to a further embodiment, the tank ventilation device can be associated with an internal combustion engine and, with the internal combustion engine running, the opening control value is only determined if the pressure in the tank ventilation device is greater than the pressure in an intake manifold of the internal combustion engine. According to a further embodiment, the tank ventilation device can be associated with an internal combustion engine and, after closing of the tank vent valve, the pressure in the tank ventilation device is increased by a pressure generating means to a predefined value which is greater than the current pressure in an intake manifold of the internal combustion engine. According to a further embodiment, the value of the control signal can be increased incrementally and, prior to an increase, the value of the control signal is kept constant for a predefined period.

According to another embodiment, a control device for a tank ventilation device of a motor vehicle, can be designed such that—a tank vent valve of the tank ventilation device is closed, —the value of a control signal for the tank vent valve is increased in terms of opening the tank vent valve until a leak detection means associated with the tank ventilation device detects a leak in the tank ventilation device, —the value of the control signal at which the leak in the tank ventilation device is detected is identified as the opening control value for opening the tank vent valve.

BRIEF DESCRIPTION OF THE DRAWINGS

The invention will now be explained in greater detail on the basis of an exemplary embodiment described with reference to the accompanying drawings in which.

DETAILED DESCRIPTION

Figure 1:
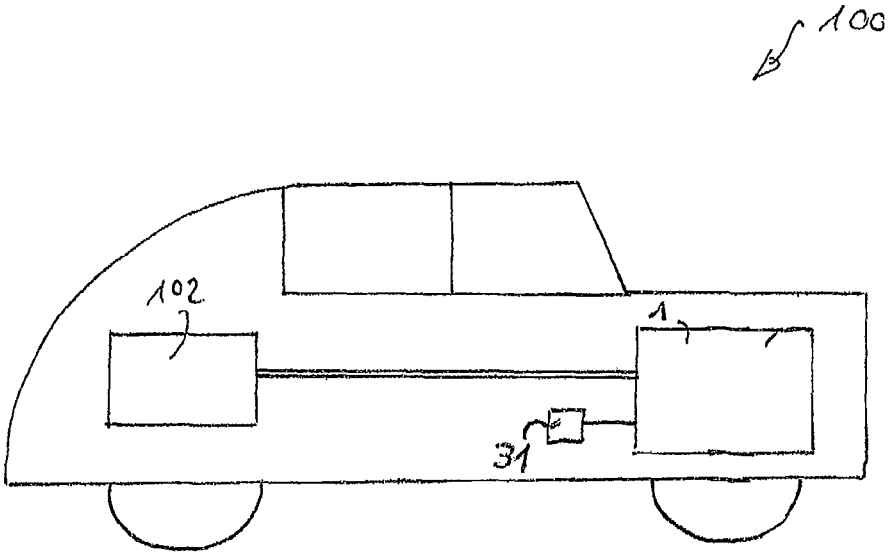
FIG. 1 shows a schematic diagram of a motor vehicle comprising an internal combustion engine and a tank ventilation device.

According to an embodiment, in a method for controlling a tank ventilation device for a motor vehicle, a tank vent valve of the tank ventilation device is first closed. The value of the control signal for the tank vent valve is then increased in terms of opening of the tank vent valve until a leak detection means associated with the tank ventilation device detects a leak in the tank ventilation device. The value of the control signal at which the leak in the tank ventilation device is detected is identified as the opening control value for opening of the tank vent valve.

In many countries, leak tightness testing of the tank ventilation device is a legal requirement. A leak detection means is therefore very often available as standard in motor vehicles. The underlying concept of the various embodiments is to determine the opening control value, i.e. the opening instant of the tank vent valve using the leak detection means, an opening tank vent valve being detected by the leak detection means as a leak in the tank ventilation device. A leak detection means of this kind is mainly designed such that even very small leaks can be detected, so that this method proves to be very precise. It enables the opening control value, i.e. the opening instant, of the tank vent valve to be determined much more accurately. In addition, depending on the configuration of the motor vehicle, this method can be carried out in virtually any operating state of the internal combustion engine. Furthermore, the method can be carried out irrespective of the degree of loading of the activated carbon canister, as it is not based on a change in the exhaust gas composition. The method therefore enables the opening control value for opening of the tank vent valve to be determined with great frequency and high precision.

In an embodiment of the method, determination of the opening control value for opening of the tank vent valve is only carried out if the tank ventilation device was previously found to be leak-free.

This ensures the process reliability of this method. Determining the opening control value of the tank vent valve only make sense if the tank ventilation device is leak-free with the tank vent valve closed. Any leak in the tank ventilation device would considerably falsify the result of the method or make it unusable. For this reason, according to this embodiment of the method, leak tightness testing of the tank ventilation device is first carried out using the leak detection means with the tank vent valve closed.

In an embodiment of the method, the leak detection means detects a leak in the tank ventilation device if the pressure in the tank ventilation device changes within an observation period.

In an embodiment of the method, the leak detection means detects a leak in the tank ventilation device if the pressure in the tank ventilation device changes by more than a predefined limit amount and/or if the gradient of the pressure change is greater than a predefined limit gradient.

In these embodiments of the method, leak detection is based on pressure monitoring in the tank ventilation device. Every leakage causes a pressure change inside the tank ventilation device. As soon as the tank vent valve opens, gas flow through the opening cross section of the tank vent valve and the pressure inside the tank ventilation device therefore changes. This pressure change is detected by the leak detection means and indicated accordingly. In this way, the opening control value for opening the tank vent valve can be determined in a simple and precise manner. The method can be made more robust by predefining a particular limit amount or a particular limit gradient for the pressure change.

In an embodiment of the method, an internal combustion engine is associated with the tank ventilation device. With the engine switched off, the opening control value for opening the tank vent valve is only determined if the pressure in the tank ventilation device is lower than the pressure in an intake manifold of the engine.

As the opening of the tank vent valve causes the activated carbon canister to be pneumatically connected to the intake manifold, this embodiment ensures that gas only flows from the intake manifold into the activated carbon canister, thus preventing an unwanted escape of hydrocarbons into the intake manifold and into the environment.

In an embodiment of the method, after closure of the tank vent valve, the pressure in the tank ventilation device is reduced by a vacuum generating means to a predefined value which is lower than the current intake manifold pressure. Many leak detection means have a vacuum generating means, for example in the form of a vacuum pump, with which a negative pressure can be produced in the tank ventilation device. Said vacuum generating means can be used to create a corresponding pressure difference with respect to the intake manifold of the internal combustion engine. In this way the opening control value for the tank vent valve can be determined with great frequency independently of the intake manifold pressure, i.e. the operating state of the engine.

In an embodiment of the method, an internal combustion engine is associated with the tank ventilation device, wherein, with the engine turned off, the opening control value is only determined if the pressure in the tank ventilation device is greater than the pressure in an intake manifold of the engine.

As opening of the tank vent valve makes it possible for gas to flow between the activated carbon canister and the intake manifold, this embodiment ensures that gas flows from the activated carbon canister into the intake manifold and therefore the hydrocarbons participate in the combustion process. A return flow of fresh air via the tank vent valve into the activated carbon canister with [the engine] turned off is undesirable and is reliably prevented according to this embodiment.

In an embodiment of the method, an internal combustion engine is associated with the tank ventilation device, wherein, after closure of the tank vent valve, the pressure in the tank ventilation device is increased by a pressure generating means to a predefined value which is greater than the current pressure in an intake manifold of the engine.

According to this embodiment, the leak detection means incorporates a pressure generating means, e.g. a pump, by means of which an excess pressure can be produced in the tank ventilation device and therefore a pressure difference with respect to the intake manifold. In this way the opening control value of the tank vent valve can be determined independently of the operating point and the intake manifold pressure of the engine, thereby providing a high degree of flexibility and frequency for carrying out the method.

In an embodiment of the method, the value of the control signal is increased incrementally, said value being kept constant for a predefined period prior to each increase.

Because of the small opening cross section of the tank vent valve, a detectable pressure change inside the tank ventilation device only arises after a certain period of time. This embodiment of the method ensures a higher process reliability for determining the opening control value of the tank vent valve.

A control device for a tank ventilation device of a motor vehicle according to an embodiment is implemented such that it can execute the method as described above. With regard to the advantages resulting therefrom, reference is made to the statements concerning the method.

FIG. 1 schematically illustrates a motor vehicle 100 having an internal combustion engine 1, a control device 31 and a tank ventilation device 102. The tank ventilation device 102 and the control device 31 are connected to the internal combustion engine 1.

Figure 2:
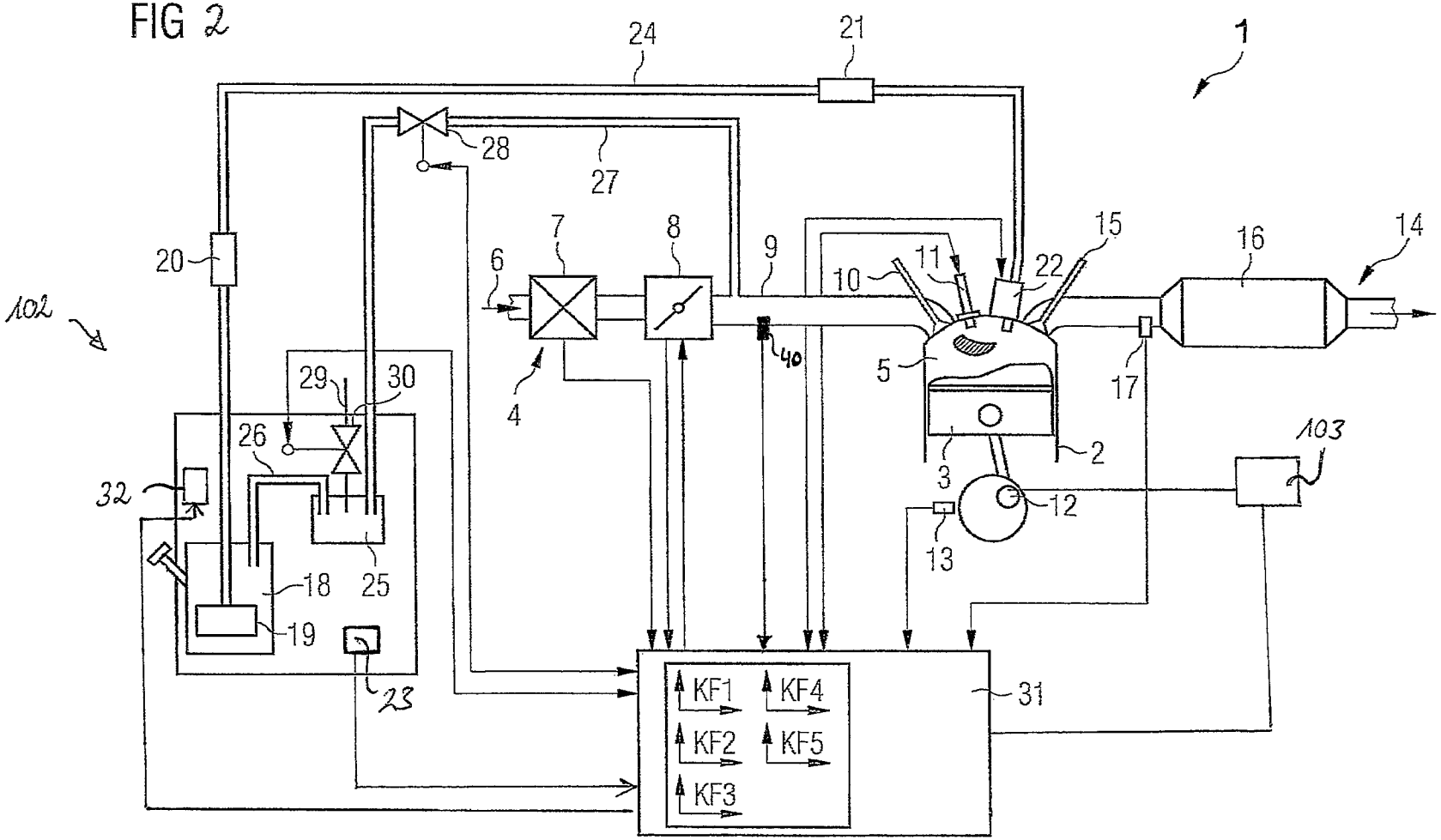
FIG. 2 shows a detailed schematic diagram of the internal combustion engine with a tank ventilation device.

FIG. 2 shows the internal combustion engine 1 and the tank ventilation device 102 in more detail.

The internal combustion engine 1 has at least one cylinder 2 and a piston 3 which can move up and down in said cylinder 2. The fresh air required for combustion is introduced via an intake tract 4 into a combustion chamber 5 delimited by the cylinder 2 and the piston 3. Located in the intake tract 4 downstream of an air intake 6 is a mass air flow sensor 7 for measuring the air flow rate in the intake tract 4, a throttle 8 for controlling the air flow, an intake manifold 9, an intake manifold pressure sensor 40 for measuring the pressure in the intake manifold 9 and an intake valve 10 by means of which the combustion chamber 5 is either connected to or isolated from the intake tract 4.

Combustion is initiated by means of a spark plug 11. The propulsion energy generated by the combustion is transmitted via a crankshaft 12 to the powertrain of the motor vehicle (not shown). A speed sensor 13 measures the RPM of the internal combustion engine 1. A starter device 103, for example an electric motor, is linked to the crankshaft 12 and is used, for example, to start the internal combustion engine 1.

The combustion waste gases are discharged via an exhaust tract 14 of the internal combustion engine 1. The combustion chamber 5 is either connected to or isolated from the exhaust tract 14 by means of an exhaust valve 15. The exhaust gases are scrubbed in a catalytic converter 16. The exhaust tract 14 also contains a so-called lambda sensor 17 for measuring the amount of oxygen in the exhaust.

The internal combustion engine 1 additionally comprises a fuel supply device with a fuel pump 19, a high-pressure pump 20, a pressure accumulator 21 and at least one controllable injection valve 22. The fuel pump 19 delivers fuel from a fuel tank 18 into a fuel supply line 24. The high-pressure pump 20 and the pressure accumulator 21 are disposed in said fuel supply line 24. The high-pressure pump 20 has the function of supplying fuel at high pressure to the pressure accumulator 21 said accumulator 21 being implemented as a common pressure accumulator (rail) 21 for all the injection valves 22. All the injection valves 22 are supplied with pressurized fuel therefrom. In the example, the engine is an internal combustion engine 1 with direct fuel injection whereby the fuel is injected directly into the combustion chamber 5 by means of the injection valve 22 projecting into the combustion chamber 5. However, it should be noted that the present invention is not limited to this type of fuel injection, but is also applicable to other types of fuel injection, such as intake manifold injection, for example.

The internal combustion engine 1 also has a tank ventilation device 102. The tank ventilation device 102 includes the fuel tank 18 and a fuel vapor accumulator 25 which is implemented for example as an activated carbon canister and is connected to the fuel tank 18 via a connecting line 26. The fuel vapors produced in the fuel tank 18 are conveyed to the fuel vapor accumulator 25 where they are adsorbed by the activated carbon. The fuel vapor accumulator 25 is connected to the intake manifold 9 of the internal combustion engine 1 via a venting line 27 which contains a controllable tank vent valve 28. In addition, fresh air can be supplied to the fuel vapor accumulator 25 via an air line 29 and an air valve 30 disposed therein. The air valve 30 can be operated for example electrically (as in the exemplary embodiment) or by a suitable pneumatic-mechanical mechanism. Additionally provided in the tank ventilation device are a pressure measuring means, for example a pressure sensor, for measuring the pressure in the tank ventilation device 102 and a pressure varying means 32 for increasing (pressure generating means) or reducing (vacuum generating means) the pressure in the tank ventilation device 32. The pressure varying means 32 can be implemented for example as an electric pressure pump (pressure generating means) or as an electric vacuum pump (vacuum generating means).

In particular operating ranges of the internal combustion engine 1, particularly during idling or partial load operation, there is a large pressure drop between ambient and the intake manifold 9 because of the powerful restricting effect of the throttle 8. As a result of opening the tank vent valve 28 and the air valve 30, there occurs during a tank venting period a scavenging effect whereby the fuel vapors stored in the fuel vapor accumulator 25 are conveyed into the intake manifold 9 and participate in combustion. The fuel vapors therefore cause a change in the composition of the combustion gases and the exhaust gases which is measured by the lambda sensor 17.

In the control device 31, engine map based engine control functions (KF1 to KF5) are realized in software. The control device 31 is connected to all the actuators and sensors of the internal combustion engine 1 via signal and data lines. In particular, the control device 31 is connected to the controllable air valve 30, the controllable tank vent valve 28, the pressure measuring means 23, the pressure varying means 32, the intake manifold pressure sensor 40, the mass air flow sensor 7, the controllable throttle 8, the controllable injection valve 22, the spark plug 11, the lambda sensor 17, the engine speed sensor 13 and the starter motor 103.

The motor vehicle comprises a leak detection means associated with the tank ventilation device 102. The leak detection means comprises the pressure measuring means 32 and parts of the software function implemented in the control device 31 and which detect and analyze the output signal of the pressure measuring means 32, said control functions detecting a pressure change in the tank ventilation device and analyzing said pressure changes for a possible leak in the tank ventilation device. If the tank ventilation device is hermetically sealed, i.e. the tank vent valve 28, the air valve 29 and all the other openings of the tank ventilation device 102 are closed to ambient conditions, and if a pressure change in the tank ventilation device 102 is nevertheless indicated by the leak detection means within a predefined observation period, a leak can be identified. A leak is advantageously only identified if the pressure change exceeds a predefined limit amount or the pressure change gradient is greater than a predefined limit gradient.

Figure 3:
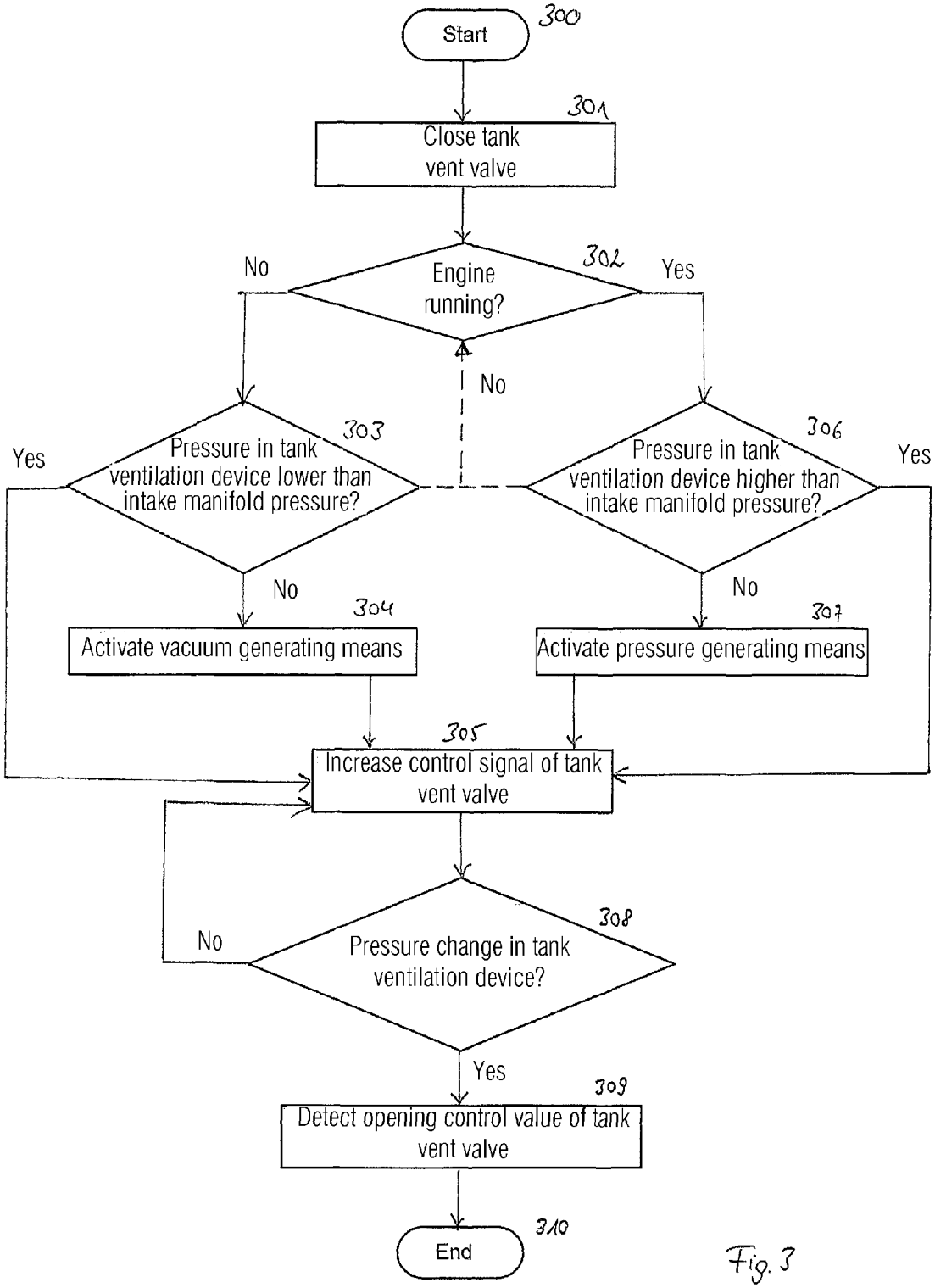
FIG. 3 shows an example of a control method for a tank ventilation device in the form of a flowchart.

FIG. 3 shows an exemplary embodiment of a control method for the tank ventilation device 102 in the form of a flowchart. The method is initiated at any point in time in step 300. This can be both with the internal combustion engine 1 running and with the engine turned off.

In step 301 the tank vent valve 28 is closed. The method then continues with step 302 in which it is checked whether the internal combustion engine 1 is running, i.e. whether fuel injection and ignition are activated and combustion is taking place in the combustion chambers 5. If this is not the case, i.e. if the internal combustion engine 1 is turned off, the method continues with step 303 in which it is checked whether the pressure in the tank ventilation device 102 is lower than a current intake manifold pressure. This can be done for example by comparing the output value of the pressure measuring means 23 with the output value of the intake manifold pressure sensor 40.

If the query in step 303 yields a negative result and the tank ventilation device has a pressure varying means 32 in the form of a vacuum generating means, the latter is activated in step 304 and the pressure in the tank ventilation device is reduced to below the current intake manifold pressure. If the tank ventilation device does not have a vacuum generating means 32, the method goes back to step 302. This alternative is indicated in FIG. 3 by a dashed arrow.

By generating negative pressure in the tank ventilation device 102 (compared to the current intake manifold pressure) with the internal combustion engine 1 turned off, it is ensured that when the tank vent valve 28 is opened, a flow of gas takes place from the intake tract 4, i.e. from the intake manifold 40, via the tank vent valve 28 into the tank ventilation device 102, thereby preventing the emission of undesirable fuel vapors from the tank ventilation device 102 into the environment.

However, if it is detected in step 302 that the internal combustion engine 1 is running, i.e. fuel injection and ignition are activated and combustion is taking place, the method continues with step 306 in which it is checked whether the pressure in the tank ventilation device 102 is higher than the current intake manifold pressure. If the tank ventilation device has a pressure varying means 32 in the form of a pressure generating means, in the event of a negative result of the query in step 306, the method continues with step 307 in which the pressure generating means is activated and the pressure in the tank ventilation device 102 is increased above the current intake manifold pressure.

If the tank ventilation device does not have a pressure generating means, in the event of a negative result from step 306 the method reverts to step 302. This alternative is also indicated by a dashed arrow.

By generating an overpressure in the tank ventilation device 102 (compared to the current intake manifold pressure) when the internal combustion engine 1 is running, it is ensured that when the tank vent valve 28 is opened, a flow of gas from the tank ventilation device 102 via the tank vent valve into the intake tract 4, or more specifically the intake manifold 40, takes place, thereby preventing an undesirable return flow of fresh air from the intake manifold 9 into the tank ventilation device 102.

If the queries in steps 303 or 306 yield a positive result 303 or, alternatively, if the pressure in the tank ventilation device 102 falls below the intake manifold pressure in step 304 or, alternatively, after increasing the pressure in the tank ventilation device 102 above the intake manifold pressure in step 307, the value of the control signal for the tank vent valve 28 is slightly increased in step 305. Increasing the value of the control signal for the tank vent valve 28 takes place in terms of opening the tank vent valve 28. After the first increase in the value of the control signal for the tank vent valve 28, once a predefined time period has elapsed, it is checked in step 308 whether a pressure change in the tank ventilation device 102 has been detected by the pressure measuring means 23 or more specifically the leak detection means. If this is not the case, the method returns to step 305 and the value of the control signal for the tank vent valve 28 is again increased by a certain amount in terms of opening the tank vent valve 28.

The value of the control signal for the tank vent valve 28 is increased until a change in the pressure in the tank ventilation device 102 is detected in step 308. In the event that the pressure in the tank ventilation device 102 is lower than the intake manifold pressure, a rise in the pressure in the tank ventilation device 102 is detected. If the pressure in the tank ventilation device 102 was greater than the intake manifold pressure, a decrease in the pressure in the tank ventilation device 102 is detected in step 308.

If the query in step 308 yields a positive result, the method continues in step 309 in which a leak in the tank ventilation device was detected by the leak detection means, which indicates opening of the tank vent valve 28. The current value of the control signal for the tank vent valve 28 is consequently identified and fixed as the opening control value of the tank vent valve 28. Due to the fact that the leak detection means has detected a leak on the basis of the pressure change in the tank ventilation device 102, opening of the tank vent valve 28 can be inferred. The robustness of the method can be improved by arranging that the method only proceeds from step 308 to step 309 either if the pressure in the tank ventilation device 102 has changed by a predefined limit amount and/or the gradient of the pressure change is greater than a predefined limit gradient.

After step 309, the method is terminated with step 310 and can be restarted again at a later point in time.

The method is advantageously carried out only if the tank ventilation device 102 has been previously detected as leak-free with the tank vent valve 28 closed. This check is also performed by the leak detection means on the basis of monitoring the pressure conditions in the tank ventilation device. For this purpose it is checked whether the pressure in the tank ventilation device changes by a predefined amount within an observation period with the tank vent valve 28 closed. If this is the case, a leak can be inferred and the method is stopped.

What is claimed is:

1. A method for controlling a tank ventilation device for a motor vehicle, comprising:

closing a tank vent valve of the tank ventilation device, increasing a value of a control signal for the tank vent valve in terms of opening the tank vent valve until a leak detection means associated with the tank ventilation device detects a leak in the tank ventilation device, identifying the value of the control signal at which the leak in the tank ventilation device is detected as the opening control value for opening the tank vent valve.

2. The method according to claim 1, wherein determination of the opening control value of the tank vent valve only takes place if the tank ventilation device was previously detected as leak-free.

3. The method according to claim 1, wherein the leak detection means detects a leak in the tank ventilation device if the pressure in the tank ventilation device changes within an observation period.

4. The method according to claim 3, wherein the leak detection means detects a leak in the tank ventilation device if at least one of the pressure in the tank ventilation device changes by more than a predefined limit amount, and if the gradient of the pressure change is greater than a predefined limit gradient.

5. The method according to claim 3, wherein the tank ventilation device is associated with an internal combustion engine and, with the internal combustion engine turned off, the opening control value is only determined if the pressure in the tank ventilation device is lower than the pressure in an intake manifold of the internal combustion engine.

6. The method according to claim 3, wherein the tank ventilation device is associated with an internal combustion engine and, after closing of the tank vent valve, the pressure in the tank ventilation device is reduced by a vacuum generating means to a predefined value which is lower than the current pressure in an intake manifold of the internal combustion engine.

7. The method according to claim 3, wherein the tank ventilation device is associated with an internal combustion engine and, with the internal combustion engine running, the opening control value is only determined if the pressure in the tank ventilation device is greater than the pressure in an intake manifold of the internal combustion engine.

8. The method according to claim 3, wherein the tank ventilation device is associated with an internal combustion engine and, after closing of the tank vent valve, the pressure in the tank ventilation device is increased by a pressure generating means to a predefined value which is greater than the current pressure in an intake manifold of the internal combustion engine.

9. The method according to claim 1, wherein the value of the control signal is increased incrementally and, prior to an increase, the value of the control signal is kept constant for a predefined period.

10. A control device for a tank ventilation device of a motor vehicle, which is configured to close a tank vent valve of the tank ventilation device, to increase the value of a control signal for the tank vent valve in terms of opening the tank vent valve until a leak detection means associated with the tank ventilation device detects a leak in the tank ventilation device, and to identify the value of the control signal at which the leak in the tank ventilation device is detected as the opening control value for opening the tank vent valve.

11. The control device according to claim 10, wherein the control device is operable to determine the opening control value of the tank vent valve only if the tank ventilation device was previously detected as leak-free.

12. The control device according to claim 10, wherein the leak detection means detects a leak in the tank ventilation device if the pressure in the tank ventilation device changes within an observation period.

13. The control device according to claim 12, wherein the leak detection means detects a leak in the tank ventilation device if at least one of the pressure in the tank ventilation device changes by more than a predefined limit amount, and if the gradient of the pressure change is greater than a predefined limit gradient.

14. The control device according to claim 12, wherein the tank ventilation device is associated with an internal combustion engine and, with the internal combustion engine turned off, the opening control value is only determined if the pressure in the tank ventilation device is lower than the pressure in an intake manifold of the internal combustion engine.

15. The control device according to claim 12, wherein the tank ventilation device is associated with an internal combustion engine and, after closing of the tank vent valve, the pressure in the tank ventilation device is reduced by a vacuum generating means to a predefined value which is lower than the current pressure in an intake manifold of the internal combustion engine.

16. The control device according to claim 12, wherein the tank ventilation device is associated with an internal combustion engine and, with the internal combustion engine running, the opening control value is only determined if the pressure in the tank ventilation device is greater than the pressure in an intake manifold of the internal combustion engine.

17. The control device according to claim 12, wherein the tank ventilation device is associated with an internal combustion engine and, after closing of the tank vent valve, the pressure in the tank ventilation device is increased by a pressure generating means to a predefined value which is greater than the current pressure in an intake manifold of the internal combustion engine.

18. The control device according to claim 10, wherein the control device is operable to increase the value of the control signal incrementally and, prior to an increase, to keep the value of the control signal constant for a predefined period.

19. A tank ventilation system for a motor vehicle, comprising:

a controllable tank vent valve arranged in a gas tank of the motor vehicle;

a leak detection sensor coupled with the tank vent valve for detecting a leak from said tank vent valve;

a control device coupled with the tank vent valve, wherein the control device is operable:

to control the tank vent valve to close, to control the tank vent valve to be opened by increasing a value of a control signal until the leak detection means associated with the tank ventilation device detects a leak in the tank ventilation device, to identifying the value of the control signal at which the leak in the tank ventilation device is detected as the opening control value for opening the tank vent valve.

* * * * *